United States Patent [19]

Takada

[11] 3,988,080

[45] Oct. 26, 1976

[54] ROTARY VANE COMPRESSOR WITH OUTLET PRESSURE BIASED LUBRICANT

[75] Inventor: Haruhiko Takada, Kawagoe, Japan

[73] Assignee: Diesel Kiki Co., Ltd., Tokyo, Japan

[22] Filed: Feb. 18, 1975

[21] Appl. No.: 550,791

[30] Foreign Application Priority Data

Feb. 20, 1974 Japan ..... 49-19384

[52] U.S. Cl. ..... 418/76; 418/77; 418/91; 418/98; 418/100; 418/255

[51] Int. Cl.[2] ..... F01C 21/04; F04C 29/02

[58] Field of Search ..... 418/88, 91, 92, 97–100, 418/255, 93, 95, 76, 77, 79

[56] References Cited

UNITED STATES PATENTS

| | | | |
|---|---|---|---|
| 2,951,633 | 9/1960 | Fites | 418/98 |
| 3,385,514 | 5/1968 | Kilgore et al. | 418/98 |
| 3,865,515 | 2/1975 | Allen | 418/97 |
| 3,877,851 | 4/1975 | Komiya et al. | 418/99 |

FOREIGN PATENTS OR APPLICATIONS

| | | | |
|---|---|---|---|
| 1,022,111 | 12/1952 | France | 418/98 |

*Primary Examiner*—John J. Vrablik
*Attorney, Agent, or Firm*—Frank J. Jordan

[57] ABSTRACT

A rotary vane compressor in which the pressure difference between inlet and outlet passages is utilized to accomplish lubrication without a supplementary oil pump comprises a housing with a cylindrical bore, a hollow rotor eccentrically rotatable on a shaft in the bore and at least one vane radially slidable in a slot in the rotor and sealingly engaging with the inner surfaces of the bore to define fluid chambers of varying volume. The compressor further has inlet and outlet passages communicating with the bore and an oil sump disposed below the bore. A first passageway connects the outlet passage with the sump, and the hollow of the rotor constitutes a second passageway. A third passageway connects the sump with one end of the hollow and a fourth passageway connects the other end of the hollow with the inlet passage. Fluid pressure in the outlet passage acts on the oil in the sump through the first passageway to force oil from the sump through the third, second and fourth passageways respectively to the inlet passage to lubricate the sliding contact portions of the rotor, shaft, vane and housing. Oil in the inlet passageway is sucked into the bore to lubricate the inner surface thereof and is discharged into the outlet passage from which it is returned to the sump through the first passageway. The third and fourth passageways may extend through chambers for bearings or mechanical seals for the shaft for lubrication thereof.

17 Claims, 12 Drawing Figures

ROTARY VANE COMPRESSOR WITH OUTLET PRESSURE BIASED LUBRICANT

The present invention relates to a rotary vane compressor in which the pressure difference between inlet and outlet passages is utilized to accomplish lubrication of the compressor moving parts without the need of a supplementary oil pump.

A fluid displacement device which may be a compressor or pump to which the present invention is applicable comprises a bored housing with a rotor eccentrically mounted within the bore. The rotor carries one or more vanes which sealingly contact the inner surfaces of the bore to displace fluid such as refrigerant gas from an inlet to an outlet when the rotor and vanes are rotated by means such as a motor. Such a device is especially practical for use as a compressor in a refrigeration or air conditioning system. Due to the compact configuration, the device is well suited to a motor vehicle air conditioning system.

A major problem in such a device is lubrication of the moving parts. Lubrication is generally accomplished by means of a supplementary oil feed pump, and an oil separator is provided to recover oil which has mixed with fluid in the bore. The oil pump increases the manufacturing cost and the size of the device, and is subject to mechanical failure which can cause damage to the device.

A prior attempt to eliminate the oil pump and utilize pressure differences in the device to accomplish lubrication is disclosed in U.S. Pat. No. 3,820,924 to Cassidy. In the disclosure, an oil sump is disposed below a compressor housing, and compressed fluid is forced from the compressor outlet through an oil separator and the space above the oil in the sump external of the device. A passageway connects the oil sump with a portion of the bore of the housing at which the fluid pressure is at least sometimes lower than the fluid pressure in the sump. Oil is thereby forced from the sump into the bore for lubrication of the moving parts of the compressor. Other passageways connect the interior of the bore with chambers housing bearings and seals for the rotor shaft, and a mixture of fluid and oil is caused to migrate in and out of the bearing and seal chambers by the pulsating fluid pressure in the bore.

The major drawback of this prior art system is that there is no positive, forced circulation of oil to the various moving parts of the compressor such as the sliding contact portions of the vanes and the rotor proper, the ends of the vanes and the end walls of the housing, the bearings and seals, and the like. The bearings and seals, for example, are lubricated by a mixture of fluid and oil rather than pure liquid oil, and tend to overheat.

It is therefore an object of the present invention to provide a fluid displacement device which may be a pump or compressor in which the pressure difference between the inlet and outlet is utilized to accomplish positive forced circulation of lubricant to the moving parts of the device.

It is another object of the present invention to provide a fluid displacement device in which an oil feed pump is not required.

It is another object of the present invention to provide a fluid displacement device featuring improved cooling of moving parts by lubricating oil.

It is another object of the present invention to provide a fluid displacement device featuring improved cooling of lubricating oil.

It is a further object of the present invention to provide a fluid displacement device which is more compact and inexpensive to manufacture on a commercial production basis than known fluid displacement devices.

The above and other objects, features and advantages of the present invention will become more clear from the following detailed description taken with the accompanying drawings, in which.

Figure 1:
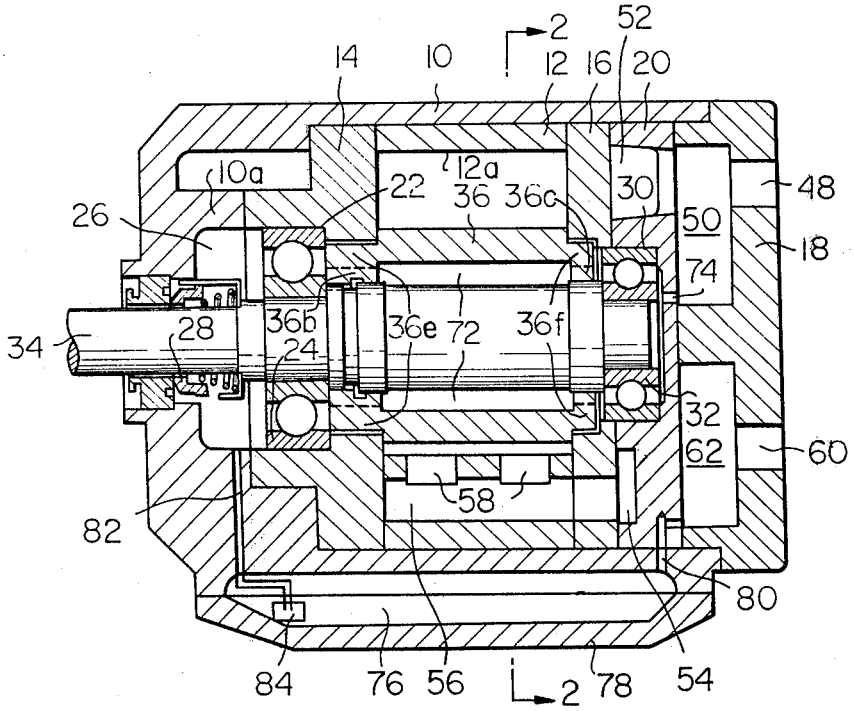
FIG. 1 is a longitudinal section of a fluid displacement device embodying the present invention.
Figure 2:
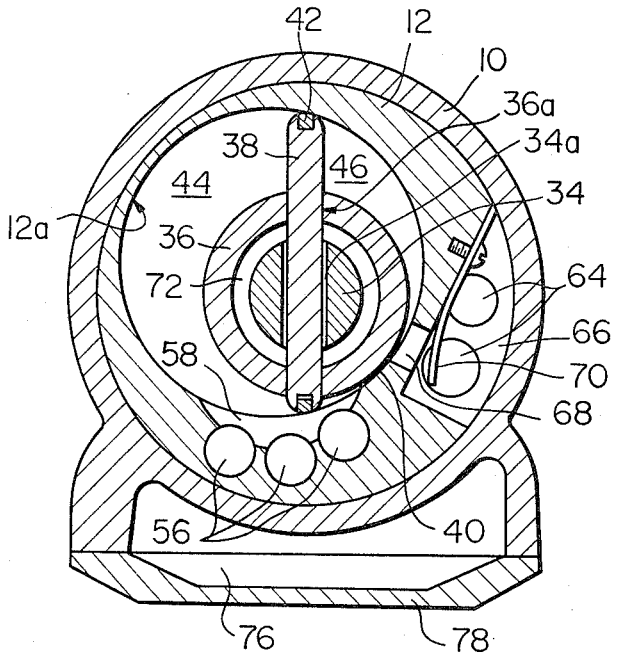
FIG. 2 is a sectional elevation on a line X—X of FIG. 1.
Figure 5A:
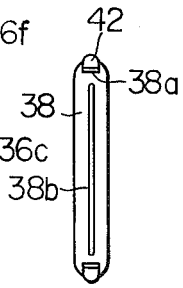
Figure 5B:
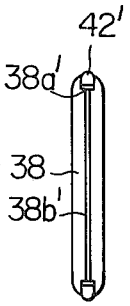
Figure 6A:
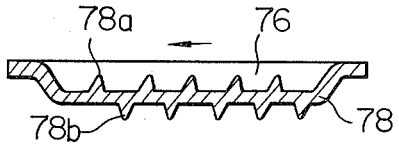
Figure 6B:
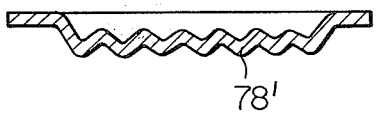
Figure 7:
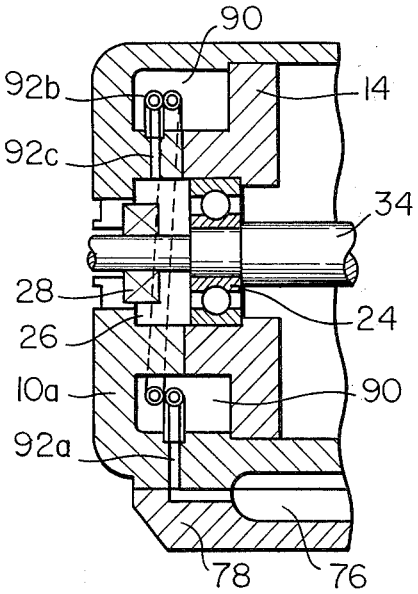
Figure 8:
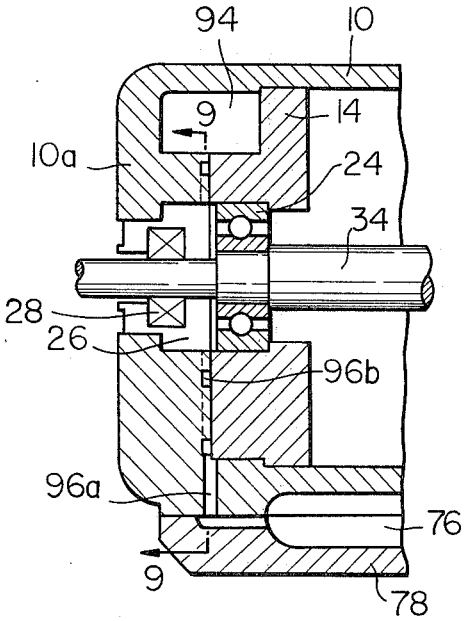
Figure 9:
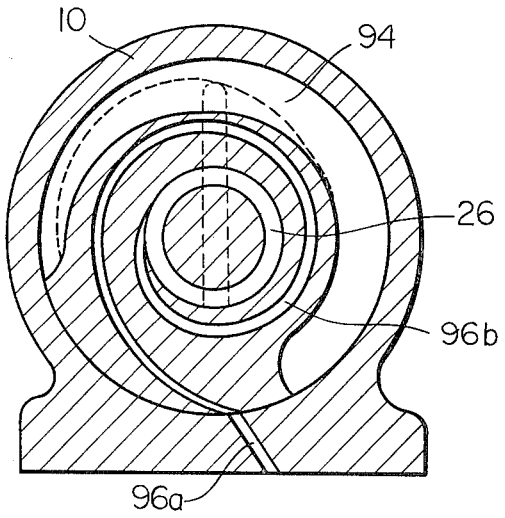

FIGS. 5*a* and 5*b* are views of an end of a vane shown in FIG. 2 illustrating various configurations thereof;

FIGS. 6*a* and 6*b* are sections of a bottom plate of an oil sump shown in FIG. 1 illustrating various configurations thereof;

FIG. 7 is a fragmentary longitudinal section illustrating a modification of a portion of the device shown in FIG. 1;

FIG. 8 is similar to FIG. 7 but illustrates another modification;

FIG. 9 is a section on a line Y—Y of FIG. 8; and

Figure 10:
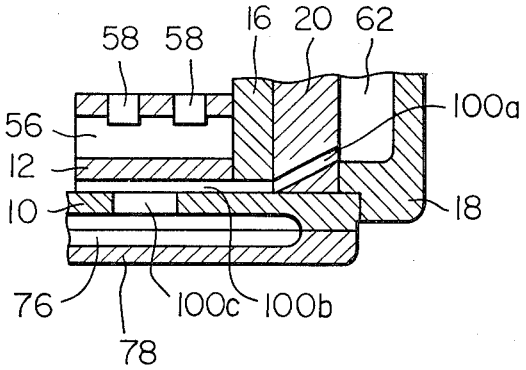

FIG. 10 is a fragmentary section of the housing of the device shown in FIG. 1 illustrating a modification thereof.

Referring to FIGS. 1 and 2, a fluid displacement device which may be a pump or compressor comprises a housing 10 with a closed end 10*a*. A cylindrically bored casing 12 is mounted in the housing 10 with end plates or walls 14 and 16 closing the ends of the bore. A partition member 20 is mounted between the end wall 16 and a cover plate 18 in the housing 10.

A bearing space or chamber 22 is formed in the end wall 14 in which is mounted a bearing 24. A mechanical seal 28 is aligned with the bearing 24 and mounted in the end wall 10*a* of the housing 10. The seal 28 extends into a seal space or chamber 26 defined by the housing 10, bearing 24 and end wall 14. Another bearing 32 is aligned with the bearing 24 and mounted in a bearing space or chamber 30 formed in the end wall 16 and partition member 20. A rotor shaft 34 is journalled in the bearings 24 abd 32 and extends through the seal 28 external of the housing 10 to be rotatably driven by a prime mover such as a motor (not shown).

A hollow circular cylindrical rotor tube 36 is fitted on the shaft 34 and is formed with diametrically opposed slots 36*a*. The shaft 34 is formed with a slot 34*a* therethrough aligned with the slots 36*a*. A blade or vane 38 is radially slidable through the slots 34*a* and 36*a* so that rotation of the shaft 34 causes the rotor tube 36 and vane 38 to rotate therewith in a unitary manner.

The profile of the bore 12*a* of the casing 12 is preferably a limacon, and the rotor shaft 34 is eccentrically rotatable in the bore 12*a* so that the rotor tube 36 is tangent to the bore 12*a* along a line 40. Apex seals 42 are carried at the edges of the vane 38 and sealingly contact the inner circumference of the bore 12*a*. The edges of the vane 38 sealingly contact the end walls 14 and 16 respectively.

The vane 38 divides the bore 12*a* into an inlet or expansion fluid working chamber 44 and an outlet or compression fluid working chamber 46.

An inlet or low pressure passage (no numeral) includes an inlet through-hole 48, leading through an inlet chamber 50, passages 52, 54 and 56 and inlet ports 58 into the bore 12*a*. The hole 48 may be connected to, for example, an evaporator of an air conditioning system (not shown).

An outlet or high pressure passage (no numeral) includes an outlet through-hole 60, which leads through an outlet chamber 62, passages 64 and 66 and outlet ports 68 into the bore 12*a*. A check valve 70 is provided to allow fluid flow only from the bore 12*a* into the passages 66 through the outlet ports 68. The hole 60 may be connected to a radiator of the air conditioning system (not shown).

Figure 3:
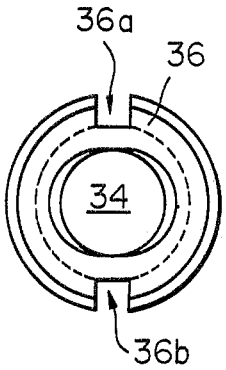
FIG. 3 is a section of a rotor shown in FIG. 2.
Figure 4:
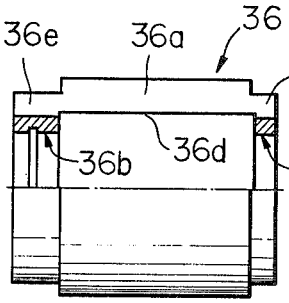
FIG. 4 is a longitudinal view, partly in section, of the rotor shown in FIG. 2.

Referring also to FIGS. 3 and 4, the rotor tube 36 is shown as longer than the vane 38, and has end portions 36*b* and 36*c* which are rotatably supported by the shaft 34 and the end walls 14 and 16. The portion of the hollow 36*d* of the rotor tube 36 through which the vane 38 extends has a larger diameter than that of the shaft 34 so that an annular space 72 is defined between the shaft 34 and the circumference of the hollow 36*d*. Longitudinal grooves 36*e* and 36*f* are formed in the outer surfaces of the end portions 36*b* and 36*c* respectively, and communicate with the space 72. A passageway constituted by the groove 36*e*, the space 72 and the groove 36*f* extends through the rotor tube 36 from left to right as viewed in FIG. 4. The grooves 36*e* and 36*f* may be aligned with the slots 36*a*, and the hollow 36*d* of the rotor tube 36 is preferably longer than the vane 38.

FIG. 5*a* shows one of the two identical ends of the vane 38. The apex seals 42 are retained in longitudinal grooves 38*a* in the edges of the vane 38. Radially extending grooves 38*b* are formed in the ends of the vane 38. As shown in FIG. 5b, the grooves 38*b'* may communicate with the grooves 38*a'*.

In accordance with an important feature of the present invention, lubricant enclosure or oil sump 76 defined by a bottom plate 78 fixed to the housing 10 is disposed below the housing 10. A passageway 80 leads from the outlet chamber 62 into the oil sump 76, preferably above the level of the oil. Another passageway 82 leads from the seal chamber 26 into the oil sump 76, preferably below the level of the oil. An oil filter 84 may be provided at the end of the passageway 82. A passageway 74 leads from the bearing chamber 30 into the inlet chamber 50. As shown in FIG. 6*a*, the inner surface of the bottom plate 78 is formed with parallel ridges 78*a* oriented perpendicular to the direction of flow (designated by an arrow) of oil through the oil sump 76 to trap foreign matter carried by the oil. Ridges or fins 78*b* may be formed on the outer surface of the bottom plate 78 to enhance radiation of heat. As shown in FIG. 6*b*, the corrugated profile of a bottom plate 78' provides the same functions.

In operation, fluid such as refrigerant gas is introduced at the hole 48 and is sucked through the inlet chamber 50, the passages 52, 54 and 56 and the inlet ports 58 into the expansion chamber 44. As the rotor tube 36 and vane 38 rotate, the volumne of the expansion chamber 44 increases until the trailing apex seal 42 covers the inlet ports 58, after which time the expansion chamber 44 is transformed into the compression chamber 46. The volume of the compression chamber 46 decreases until the trailing apex seal 42 covers the outlet ports 68. By this action, gas is compressed in the compression chamber 46 and forced out the hole 60 through the outlet ports 68, the passages 66 and 64 and the outlet chamber 62.

Due to the operation of the device, the gas pressure in the outlet chamber 62 is higher than the gas pressure in the inlet chamber 50. This phenomenon is utilized in a novel and practical manner in the invention to provide circulation of lubricating oil to the moving parts of the device.

Pressurized gas from the outlet chamber 62 is introduced into the oil sump 76 through the passageway 80. This gas acts on the oil in the sump 76 to force oil from the sump 76 into the seal chamber 26 through the passageway 82 to lubricate the seal 28. Oil flows from the seal chamber 26 into the bearing chamber 22 to lubricate the bearing 24. Oil flows from the bearing chamber 22 into the grooves 36*e* to lubricate the contact areas of the end portion 36*b* of the rotor tube 36 and the end wall 14. Oil flows through the grooves 36*e* into the space 72 to lubricate the sliding contact portions of the vane 38, the rotor tube 36 and the rotor shaft 34. Oil flows from the space 72 into the grooves 36*f* to lubricate the contact areas of the end portion 36*c* of the rotor tube 36, the end wall 16 and the partition member 20. Oil flows through the grooves 36*f* into the bearing chamber 30 to lubricate the bearing 32. Oil flows from the bearing 30 through the passageway 74 into the inlet chamber 50.

Oil from the space 72 flows through the grooves 38b to lubricate the contact portions of the ends of the vane 38 and the end walls 14 and 16 respectively. In the embodiment shown in FIG. 5*b*, oil from the space 72 flows through the grooves 38*b'* into the grooves 38*a'* to lubricate the apex seals 42'. The apex seals 42' also act to clean excess oil from the inner circumference of the bore 12*a*. Oil scraped by the apex seals 42' is forced through the grooves 38*a'* and 38*b'* into the space 72 for recirculation.

Oil in the inlet chamber 50 is mixed with refrigerant gas and sucked into the expansion chamber 44 in a turbulent manner to lubricate all surfaces defining the expansion chamber 44. As the expansion chamber 44 is transformed into the compression chamber 46, the oil lubricates all surfaces defining the compression chamber 46.

Oil in the compression chamber 46 is discharged into the outlet chamber 62 along with the refrigerant gas. The gas flows out of the outlet chamber 62 through the hole 60, but the oil is separated from the gas, and is returned to the oil sump 76 through the passageway 80.

If desired, the passageways 80 and/or 82 may be constricted in order to control the flow rate of oil through the device and the oil pressure in the space 72.

It is known in the art that the gas temperature at the inlet of a compressor or pump is lower than at the outlet. This fact may be utilized to provide cooling of the oil. As shown in FIG. 7, an annular inlet chamber 90 is provided which communicates with the inlet chamber 50. The passageway 82 is replaced by a passageway 92*a* communicating with the oil sump 76, a passageway 92*c* communicating with the seal chamber 26 and a tube 92*b* connecting the ends of the passageways 92*a* and 92*c*. The tube 92*b* is wound in a spiral or helical shape and is disposed in the inlet chamber 90. In operation, oil flowing through the tube 92*b* is cooled by the cool refrigerant gas in the inlet chamber 90.

As shown in FIGS. 8 and 9, the tube 92*b* may be replaced by a spiral groove 96*b* formed in the face of either the closed end 10*a* of the housing 10 or the end wall 14 where the end 10*a* and wall 14 contact each other. The spiral groove is connected at one end through a passageway 96*a* to the oil sump 76 and at the other end to the seal chamber 26. The spiral groove 96*b* therefore constitutes a passageway through a wall defining an inlet chamber 94 similar to the inlet chamber 90, and oil flowing through the spiral groove 96*b* is cooled by conduction by the cool gas in the inlet chamber 94.

It is also known in the art that some areas of the end wall 14 are always cooler than others due to the operation of the device. The sprial groove 96*b* may be arranged to extend through these cool areas to further facilitate cooling of the oil.

In a device of the present invention, the oil in the sump 76 is cooled mainly by conduction and radiation through the bottom plate 78. The passageway 80 connecting the outlet chamber 62 and the oil sump 76 may further be adapted to take advantage of cooling the oil flowing from the outlet chamber 62 into the sump 76. As shown in FIG. 10, the passageway 80 is replaced by a passageway 100*a*, which leads from the outlet chamber 62 through a passageway 100*b* and an enlarged opening 100*c* into the oil sump 76. The passageway 100*a* is formed through the partition member 20. The passageway 100*b* is formed through the end wall 16 and the casing 12, and may be in the form of a groove. The opening 100*c* is of larger diameter than either of the passageways 100*a* and 100*b* to facilitate cooling of the oil through the housing 10, and is formed through the wall of the housing 10. The passageway 100*b* is formed close to the passages 56 so that oil passing therethrough is cooled by conduction through the wall of the casing 12 defining the passages 56 by cool inlet gas flowing through the passages 56.

The present invention provides the following and other advantages, including those realized empirically by reduction to practice of a device embodying the invention.

1. Lubricating oil is recovered in the outlet chamber, thereby preventing degradation of the cooling effect of the refrigerant gas which would be caused if oil were pumped through the air conditioning system along with the gas.

2. Positive forced circulation of lubricating oil is accomplished utilizing the pressure difference between the inlet and outlet passages of the device, and an oil feed pump is not required.

3. Since oil is fed into the inlet chamber, it is scattered all over the inner surfaces of the casing bore 12*a* for effective lubrication.

4. The oil pressure in the space 72 and flow rate may be controlled by suitably constricting the passageways 80 and/or 82.

5. The cooling of both the oil and the moving parts of the device is effectively accomplished. As the temperature of the mechanical parts of the device and thereby the oil increases, the viscosity of the oil will decrease and the flow rate will increase to automatically increase the cooling effect.

6. Foaming of oil in the oil sump 76 is reduced, since the sump 76 is pressurized by fluid in the outlet chamber 62.

7. Due to the provision of the seal chamber 26 adjacent to the oil sump in the forced oil circulation path, metal particles and other foreign matter resulting from mechanical friction are carried away from the seal 28 by the oil rather than entering into and degrading the seal 28.

It will be understood that the present invention is not limited to a rotary vane pump or compressor as shown and described, but may be adapted to many types of fluid displacement devices. Certain aspects of the invention may also be applied to fluid motors. Rather than a single vane 38, a plurality of vanes may be provided, and the rotor tube and casing bore may be of any operable cross section, such as circular or trochoidal. The rotor tube and shaft may of course be integral, as long as a longitudinal passageway is provided therethrough. Various applications may also be found in centrifugal and other pumps or compressors having rotors.

What is claimed is:

1. In a fluid displacement device having a bored housing, a rotor rotatable in the bore of the housing to define fluid chambers of varying volume, the rotor comprising a rotor shaft journalled in the housing and a hollow rotor tube mounted on the rotor shaft for rotation therewith, the housing being formed with a high pressure passage and a low pressure passage operatively communicating with the fluid chambers in the bore, bearing chambers formed through the housing, bearings mounted in the bearing chambers and supporting the rotor shaft, a lubricant enclosure on said housing, a first passageway formed through a wall of the housing defining the high pressure passage to connect the high pressure passage with the lubricant enclosure, a second passageway formed axially through the rotor, at least part of the second passageway being constituted by a portion of the hollow of the rotor tube, a third passageway connecting the lubricant enclosure with one end of the second passageway of the rotor, part of the third passageway being constituted by one of the bearing chambers, the first and third passageways being constricted, and a fourth passageway connecting the other end of the second passageway of the rotor with the low pressure passage, another bearing chamber comprising part of the fourth passageway, whereby lubricant is forced from the enclosure through the third, second and fourth passageways and the low pressure passage into the bore of the housing to lubricate the rotor and the interior of the housing by the fluid pressure in the high pressure passage acting on the lubricant in the enclosure through the first passageway, discharged from the bore into the high pressure passage with the fluid and returned to the lubricant enclosure through the first passageway.

2. The device of claim 1, in which the third passageway comprises a tube extending through the inlet passage for cooling the lubricant.

3. The device of claim 1, in which the rotor shaft extends external of the housing, the housing is formed with a seal chamber, and in which the device further comprises a seal mounted in the seal chamber through which the rotor shaft sealingly extends external of the housing, the seal chamber constituting part of the third passageway.

4. The device of claim 1, in which a portion of the third passageway is formed through a wall of the housing defining the inlet passage.

5. The device of claim 4, in which the portion of the third passageway is in the form of a spiral.

6. The device of claim 1, further comprising a vane radially slidably carried by the rotor and sealingly engaging with the inner circumference of the housing, the ends of the vane sealingly engaging with end walls closing the bore of the housing.

7. The device of claim 6, in which the vane is diametrically sealingly slidable in a slot formed through the rotor and sealingly contacts the inner circumference of the housing at its two edges.

8. The device of claim 6, in which the rotor is eccentrically rotatably mounted in the bore of the housing and tangent to the inner circumference of the housing.

9. The device of claim 6, in which the ends of the vane are formed with radially extending grooves communicating with the second passageway of the rotor for lubrication of the contacting portions of the ends of the rotor and the end walls of the housing.

10. The device of claim 9, in which the edge of the vane is formed with a groove, and which further comprises a seal member retained in the groove to provide a seal between the edge of the vane and the inner circumference of the housing, the grooves in the ends of the vane communicating with the groove in the edge of the vane for lubrication of the seal member.

11. The device of claim 1, in which the lubricant enclosure is disposed below the housing whereby lubricant is urged by gravity to flow from the high pressure passage into the enclosure through the first passageway.

12. The device of claim 11, in which the bottom inner surface of the lubricant enclosure is formed with ridges to trap foreign matter carried by the lubricant.

13. the device of claim 11, in which the outer surface of the lubricant enclosure is formed with ridges for radiation of heat from the enclosure and cooling of the lubricant.

14. The device of claim 1 in which said portion of the rotor tube is of larger diameter than the diameter of the rotor shaft.

15. The device of claim 14, in which the portion of the hollow of the rotor tube is longer than the vane.

16. The device of claim 14, in which the rotor tube is longer than the vane, and in which axial grooves are formed in the rotor tube connecting the portion of the hollow with the third and fourth passageways respectively and constituting part of the second passageway.

17. The device of claim 16, in which the axial grooves are aligned with the vane.

* * * * *